US007673691B2

(12) United States Patent
Jansch

(10) Patent No.: US 7,673,691 B2
(45) **Date of Patent: *Mar. 9, 2010**

(54) APPARATUS FOR RETAINING TWO STRINGS OF TUBULARS

(75) Inventor: Manfred Jansch, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 53 days.

This patent is subject to a terminal disclaimer.

(21) Appl. No.: 11/552,023

(22) Filed: Oct. 23, 2006

(65) Prior Publication Data

US 2007/0102162 A1 May 10, 2007

Related U.S. Application Data

(63) Continuation of application No. 10/174,416, filed on Jun. 18, 2002, now Pat. No. 7,124,828, which is a continuation of application No. 09/530,197, filed as application No. PCT/GB98/03198 on Oct. 27, 1998, now Pat. No. 6,422,311.

(30) Foreign Application Priority Data

Oct. 28, 1997 (DE) ..... 197 47 468

(51) Int. Cl.
*E21B 33/047* (2006.01)

(52) U.S. Cl. ..... 166/382; 166/75.14; 166/85.1; 166/88.4; 166/208; 166/385

(58) Field of Classification Search ..... None
See application file for complete search history.

(56) References Cited

U.S. PATENT DOCUMENTS 1,541,669 A 6/1925 Summers
2,048,682 A * 7/1936 Borgadt ..... 219/61.7
2,063,361 A 12/1936 Baash
2,298,507 A 10/1942 Penick et al.
2,381,929 A * 8/1945 Schlumberger ..... 166/55.1
2,589,159 A 3/1952 Stone
2,620,420 A * 12/1952 Abbott ..... 219/80
2,904,836 A * 9/1959 Jefferson et al. ..... 425/433
2,934,148 A 4/1960 Allaire
2,986,364 A * 5/1961 Vestal ..... 248/75
2,988,145 A * 6/1961 Clark, Jr. ..... 175/317
3,063,509 A 11/1962 Guier (Continued)

FOREIGN PATENT DOCUMENTS

CA 2 284 428 4/2001

(Continued)

OTHER PUBLICATIONS

Dual Elevator on KTB Rig, Bohranlage, Bohrplatz und Bohrlochsicherungssystem, p. 449-450.

*Primary Examiner*—Zakiya W. Bates
(74) *Attorney, Agent, or Firm*—Patterson & Sheridan, LLP

(57) ABSTRACT

An apparatus for retaining two strings of tubulars characterized in that said apparatus comprises body parts of a device for retaining a single string of tubulars and a converting member. A device for retaining a string of tubulars, said device comprising at least one body part having a curved tapered surface upon which inserts are located for engagement with said string of tubulars characterized in that said curved tapered surface comprises a recess for the passage of cables.

25 Claims, 5 Drawing Sheets

U.S. PATENT DOCUMENTS 3,068,344 A * 12/1962 Keinanen et al. ..... 219/68
3,099,323 A 7/1963 Kelley
3,171,730 A * 3/1965 Zauner ..... 65/109
3,188,708 A 6/1965 O'Haver
3,287,776 A 11/1966 Brown
3,330,354 A 7/1967 Chamblee
3,393,549 A * 7/1968 Gregg ..... 72/312
3,413,046 A * 11/1968 Kincaid ..... 384/192
3,421,130 A * 1/1969 Leonard et al. ..... 337/157
3,618,144 A * 11/1971 Frey et al. ..... 5/427
3,675,278 A * 7/1972 Powell ..... 294/102.2
3,748,702 A 7/1973 Brown
4,035,012 A 7/1977 Guier
4,057,406 A * 11/1977 Jansson ..... 55/385.1
4,084,739 A * 4/1978 Koltz et al. ..... 228/168
4,100,780 A * 7/1978 Sassak ..... 72/14.9
4,126,348 A 11/1978 Palmer
RE29,995 E 5/1979 Guier
4,208,158 A 6/1980 Davies et al.
4,209,066 A 6/1980 Watson
4,318,499 A * 3/1982 Hamilton ..... 222/327
4,326,745 A 4/1982 Guier
4,354,706 A 10/1982 Coyle, Sr.
4,381,584 A 5/1983 Coyle, Sr.
4,396,216 A 8/1983 Hamilton
4,417,846 A 11/1983 Elliston
4,421,447 A 12/1983 Gudgel et al.
4,489,016 A * 12/1984 Kriebel ..... 261/122.1
4,489,794 A 12/1984 Boyadjieff
4,523,645 A * 6/1985 Moore ..... 166/385
4,600,054 A 7/1986 Miller et al.
4,608,754 A * 9/1986 Kloster ..... 30/92
4,632,739 A * 12/1986 LaValley ..... 205/351
4,643,259 A 2/1987 Zeringue, Jr.
4,700,692 A * 10/1987 Baumgartner ..... 600/7
4,709,574 A * 12/1987 Horn et al. ..... 72/405.12
4,715,456 A 12/1987 Poe, Jr. et al.
4,773,827 A * 9/1988 Zaiser ..... 417/183
4,800,968 A 1/1989 Shaw et al.
4,809,735 A * 3/1989 Volgstadt et al. ..... 137/318
4,843,945 A 7/1989 Dinsdale
4,867,236 A 9/1989 Haney et al.
5,042,601 A 8/1991 Penisson
5,083,356 A 1/1992 Gonzalez et al.
5,330,000 A * 7/1994 Givens et al. ..... 166/134
5,335,756 A 8/1994 Penisson
5,484,040 A 1/1996 Penisson
5,528,830 A * 6/1996 Hansen ..... 30/97
5,609,226 A 3/1997 Penisson
5,791,410 A 8/1998 Castille et al.
5,848,647 A 12/1998 Webre et al.
5,907,768 A 5/1999 Malta et al.
6,056,060 A 5/2000 Abrahamsen et al.
6,089,338 A 7/2000 Bouligny, Jr.
6,131,664 A 10/2000 Sonnier
6,192,981 B1 2/2001 Boquet et al.
6,237,684 B1 5/2001 Bouligny, Jr. et al.
6,378,399 B1 4/2002 Bangert
6,422,311 B1 7/2002 Jansch
6,591,471 B1 7/2003 Hollingsworth et al.
6,742,596 B2 6/2004 Haugen
6,920,931 B1 7/2005 Webre et al.
7,044,216 B2 5/2006 Otten et al.
7,124,828 B2 10/2006 Jansch
7,216,716 B2 5/2007 Cole et al.
7,222,677 B2 5/2007 Webre et al.
2002/0096337 A1 7/2002 Bouligny et al.
2003/0066718 A1 4/2003 Buck
2003/0173117 A1 9/2003 Mason et al.
2004/0035587 A1 2/2004 Hollingsworth et al.
2004/0069500 A1 4/2004 Haugen
2004/0079533 A1 4/2004 Buytaert et al.
2005/0000696 A1 1/2005 McDaniel et al.
2005/0161225 A1 7/2005 Cole et al.
2005/0161227 A1 7/2005 Hayes et al.
2005/0161230 A1 7/2005 Webre et al.

FOREIGN PATENT DOCUMENTS

DE 19814033 10/1999
EP 0 479 583 4/1992
FR 2 658 972 8/1991
GB 2 014 215 8/1979
GB 2 355 030 4/2001
WO WO 99/10674 3/1999
WO WO 01/69034 9/2001

* cited by examiner

APPARATUS FOR RETAINING TWO STRINGS OF TUBULARS

CROSS-REFERENCE TO RELATED APPLICATIONS

This is a continuation of U.S. patent application Ser. No. 10/174,416, filed on Jun. 18, 2002, now U.S. Pat. No. 7,124,828, which is a continuation of U.S. patent application Ser. No. 09/530,197, filed on Apr. 25, 2000, now U.S. Pat. No. 6,422,311, which is the § 371 National Stage of International Application No. PCT/GB98/03198, filed on Oct. 27, 1998, which claims benefit of German application No. 19747468, filed on Oct. 28, 1997, which applications and patent are herein incorporated by reference in their entirety.

BACKGROUND OF THE INVENTION

1. Field of the Invention

The invention relates to an apparatus for retaining two strings of tubulars, and is particularly but not exclusively for use as a spider in the platform of an oil rig and also for use in an elevator of an oil rig. The invention also relates to a device for retaining a string of tubulars the device comprising at least one body part having a curved tapered surface upon which inserts are located for engagement with the string of tubulars.

2. Description of the Related Art

In the formation and operation of oil or gas wells it is desirable to lower a string of tubulars into the well. For this purpose, a retaining device is used in a platform of the rig, known as a spider, and a corresponding retaining device in an elevator of the rig. The string of tubulars is initially retained from falling down the well by the spider. Additional stands of tubulars are moved from a rack to a position above the spider. The stand of tubulars is connected to the string. The device in the elevator is placed around the top of the lengthened string of tubulars. The spider is then released from engagement with the string, and the device in the elevator now takes the full weight of the lengthened string of tubulars. The elevator moves downwardly towards the spider, lowering the lengthened string of tubulars. The spider engages the lengthened string of tubulars and the elevator is subsequently released from engagement therewith. This process is reversed for pulling a string of tubulars out of a well.

It is often desired to lower two substantially parallel strings of tubulars simultaneously, such as a delivery pipe and an injection pipe used in the forced extraction of oil or gas from a well or used in trial wells.

A problem associated with prior art devices is that their construction is large, expensive and can only be used for retaining two strings of tubular.

SUMMARY OF THE INVENTION

Accordingly there is provided an apparatus for retaining two strings of tubulars characterized in that said apparatus comprises body parts of a device for retaining a single string of tubulars and a converting member.

Other features and aspects of the present invention are set out in claims 2 to 9.

There is also provided a device for retaining a string of tubulars, said device comprising at least one body part having a curved tapered surface upon which inserts are located for engagement with said string of tubulars characterized in that said curved tapered surface comprises a recess for the passage of cables.

BRIEF DESCRIPTION OF THE DRAWINGS

For a better understanding of the present invention, reference will now be made, by way of example, to the accompanying drawings, in which.

DETAILED DESCRIPTION

Figure 1:
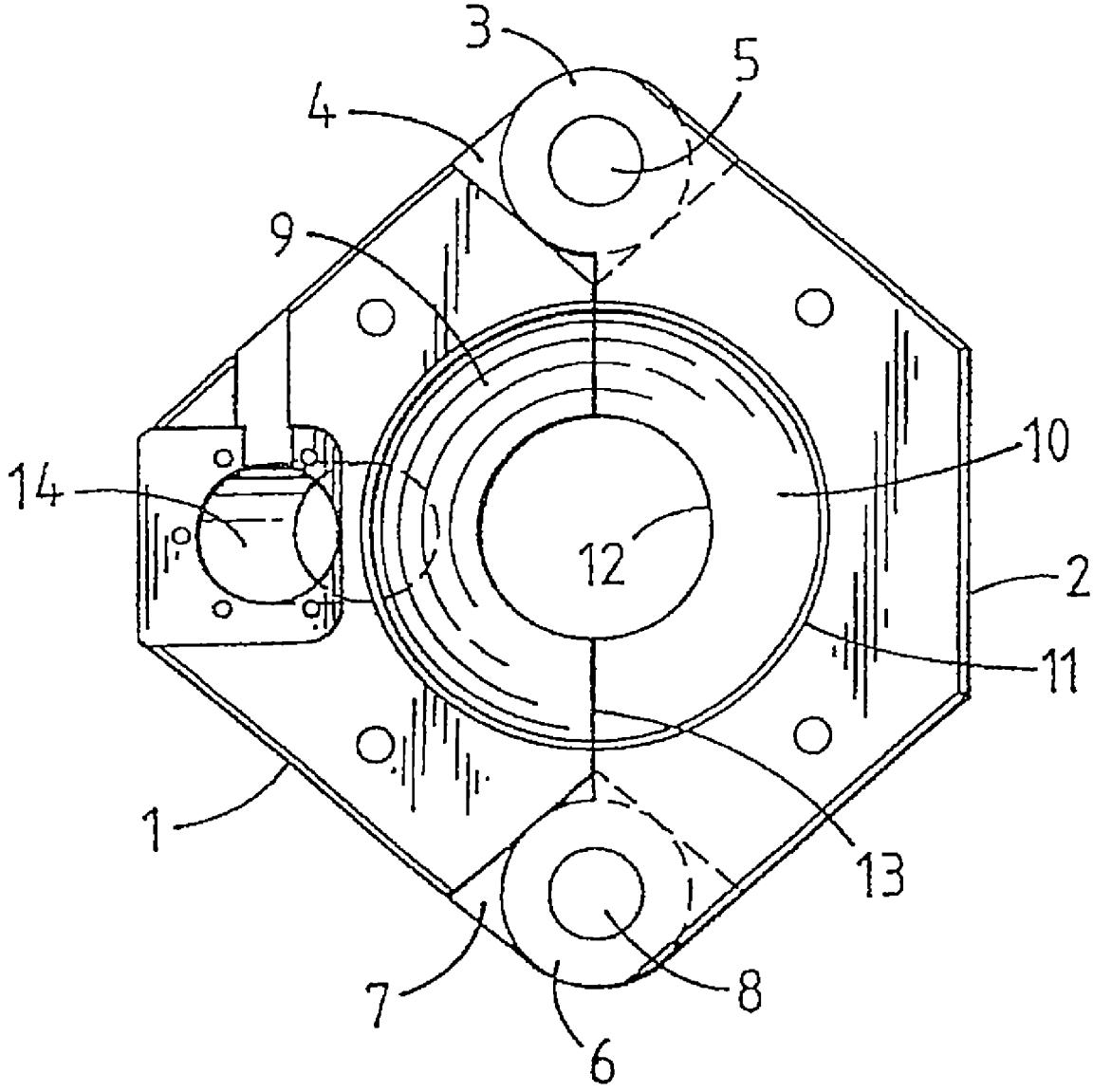
FIG. 1 (PRIOR ART)
FIG. 1 is a top plan view of a prior art device for retaining a single string of tubulars.

Referring to FIG. 1 there is shown a prior art device for retaining a single string of tubulars. The device comprises two body parts 1 and 2. The body parts 1 and 2 are generally triangular in shape and are hinged in relation to one another by means of inter engaging rows of eyelets 3 and 4 and a hinge pin 5 at one corner thereof. Each row of eyelets 3 and 4 is integral with the respective body part 1 and 2. The body parts 1 and 2 also have inter engaging rows of eyelets 6 and 7 on the opposite corners thereof. The body parts 1 and 2 may be locked together by use of a locking pin 8 insertable through the rows of eyelets 6 and 7.

The body parts 1 and 2 are provided with semicircular tapered surfaces 9 and 10 which taper downwardly from a first diameter 11 to a second smaller diameter 12. In use, corresponding tapered inserts (not shown) are provided on the tapered surface for gripping the tubular which runs therethrough. The weight of the tubular string will be transferred from the tapered inserts to the tapered surfaces 9 and 10.

A gap 13 is provided between the body parts 1 and 2. Body part 1 also comprises an opening 14 which runs from the top to the bottom of the body part 1 and lies parallel to the tapered surface 9. The opening 14 is provided for receiving an actuating piston and cylinder (not shown) which, in use, moves the tapered inserts along the tapered surfaces 9 and 10 for engaging or disengaging the inserts with a tubular. The actuating piston and cylinder may be hydraulic or pneumatic.

In use, two such devices are used. One device is mounted in an elevator and the other is mounted in the floor of an oil rig. A string of tubulars, such as casing, is first retained in the device mounted in the floor of the oil rig. A section of casing may then be added or taken away from the string of casing thereabove. This may be achieved by using tubular handling equipment to move the section of casing to a position above the string of casing, and a tong to facilitate connection or disconnection of the section of casing to or from the string of casing. The device mounted in the elevator may now be used to retain the section of casing extending above the device in the floor of the oil rig. The device in the floor of the oil rig may now be disengaged from the string of tubulars. The elevator is then operated to lower or raise the entire string of casing. The device in the rig floor is then used to retain the string of casing once again.

Referring to FIGS. 2 to 6 there is shown an apparatus for retaining two strings of tubulars, the apparatus being in accordance with the invention. The apparatus is generally identified by the reference numeral 100.

The apparatus 100 comprises body part 101 which is generally similar to body part 1 of FIG. 1, body part 102 which a mirror image of the body part 1 of FIG. 1 and a converting member 103.

Figure 6:
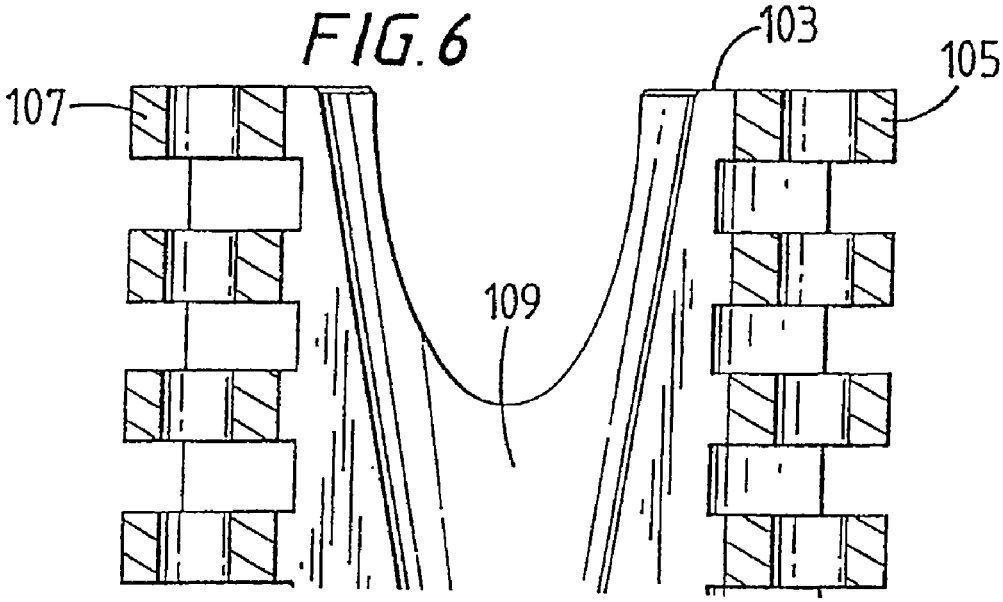
FIG. 6 is a cross sectional view of the part of the apparatus of FIG. 4 taken along the line VI-VI.

The converting member 107 is generally rectangular in shape with rows of eyelets 104, 105, 106, 107 at each corner thereof. The converting member is provided with two semicircular tapered surfaces 108, 109 which taper downwardly from a first diameter 110 to a smaller diameter 111. The semicircular tapered surfaces 108, 109 oppose each other and merge as the diameter increases from the smaller diameter to the first diameter as shown in FIG. 6. In use, corresponding tapered inserts (not shown) are provided on the tapered surfaces 108, 109 for gripping a tubular.

The converting member 103 is arranged between the body parts 101 and 102 and are hinged thereto. A row of eyelets 112 is integral with one corner of the body part 101 and inter engages with the row of eyelets 104 of the converting member 103 and a hinge pin 113 is located therethrough. A row of eyelets 114 is integral with a first corner of the body part 102 and inter engages with the row of eyelets 105 of the converting member 103 and a hinge pin 115 is located therethrough. A row of eyelets 116 is integral with an opposing corner of body part 101 and inter engages with a row of eyelets 106 of the converting member 103 and a locking pin 117 may be inserted therethrough to lock the body part 101 to the converting member 103. A row of eyelets 118 is integral with an opposing corner of body part 102 and inter engages with the row of eyelets 107 of the converting member 103 and a locking pin 119 may be inserted therethrough to lock the body part 102 to the converting member 103.

Each of the body parts 101 and 102 are provided with corresponding tapered surfaces 120 and 121 and with openings 122 and 123 for receiving actuating pistons and cylinders as described with reference to the device of FIG. 1.

In use, two such apparatuses are used, one as a spider in the platform of an oil rig and the other in the elevator of the oil rig. The method of operation is much the same as that described with reference to the device of FIG. 1, except that two actuating pistons and cylinders are used to move the tapered inserts along the tapered surfaces 108, 109, 120 and 121 for engaging or disengaging the inserts with a tubular.

Figure 7:
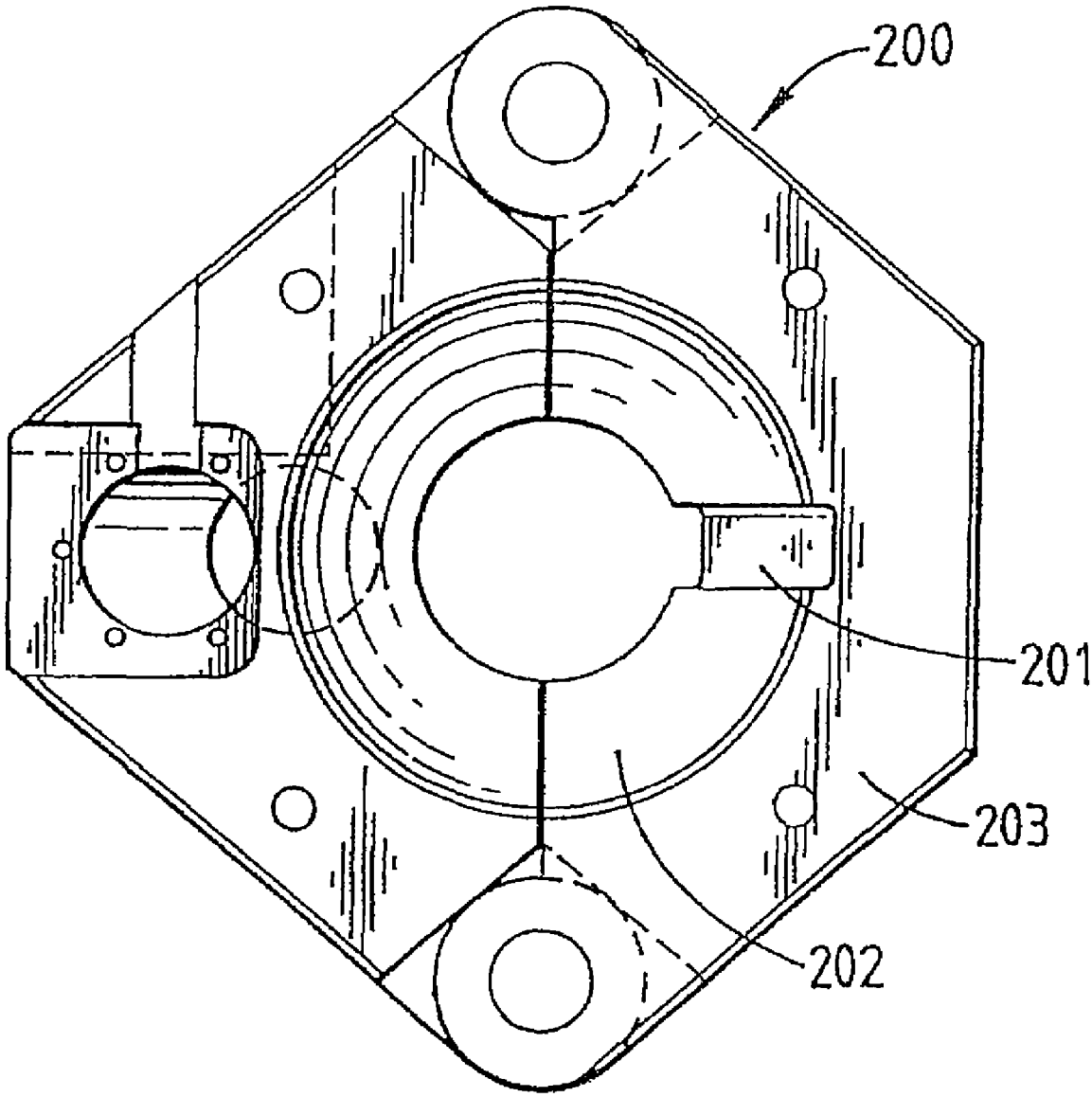
FIG. 7 is a top plan view of an apparatus for retaining a single string of tubulars, the apparatus being in accordance with a second aspect of the invention.

Referring now to FIG. 7 there is shown a device, generally identified by reference numeral 200.

The device 200 is generally similar to the device shown in FIG. 1 with the additional feature of a recess 201 in the tapered surface 202 of the body part 203. The recess 201 is sized to accommodate a loom of cables running substantially parallel to the string of tubulars. This enables the cable strings to pass through the device for retaining a string of tubulars, for example, through a spider.

Figure 8:
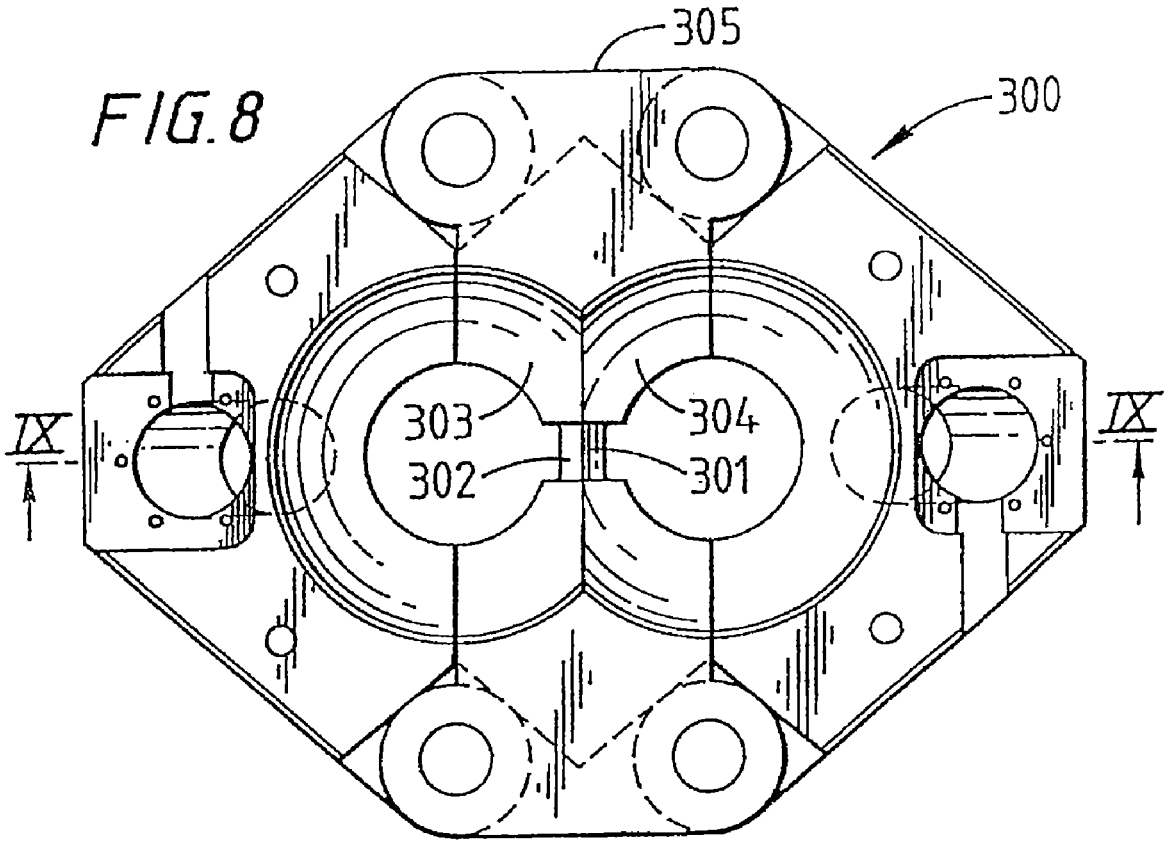
FIG. 8 is a top plan view of an alternative apparatus for retaining two strings of tubulars, the apparatus being in accordance with the first and second aspects of the invention.
Figure 9:
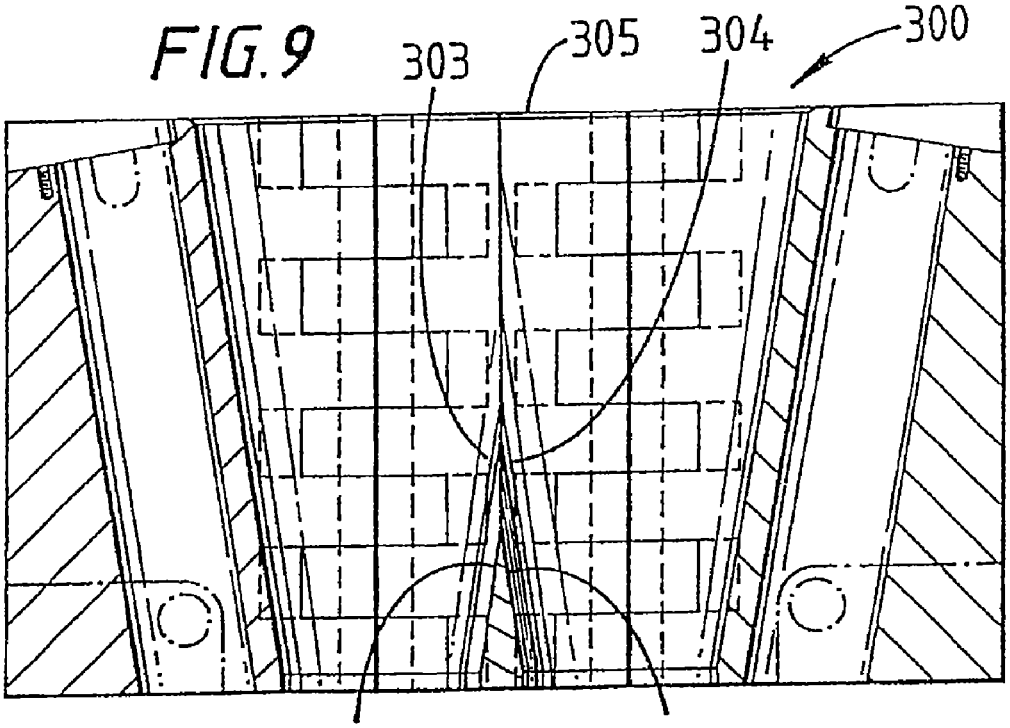
FIG. 9 is a cross sectional view of the apparatus of FIG. 8 taken along the line IX-IX.

FIGS. 8 and 9 show an apparatus generally identified by reference numeral 300.

Figure 2:
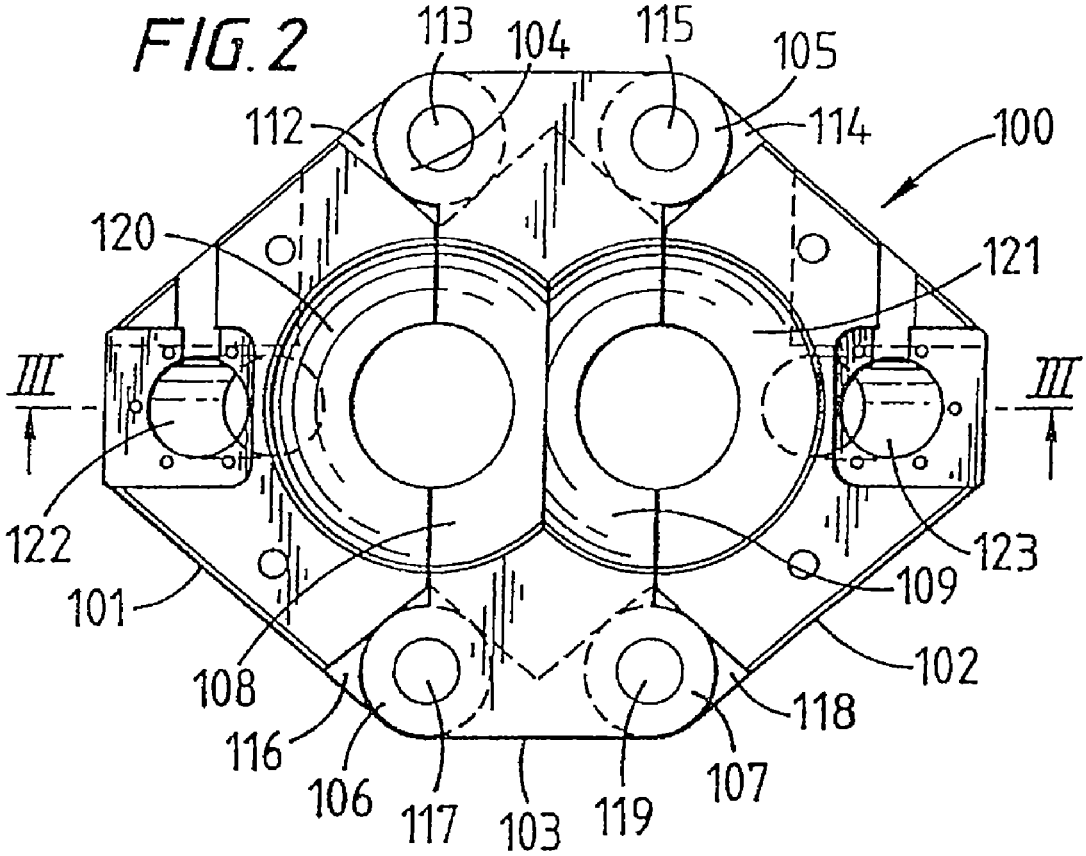
FIG. 2 is a top plan view of an apparatus for retaining two strings of tubulars, the apparatus being in accordance with a first aspect of the invention.
Figure 3:
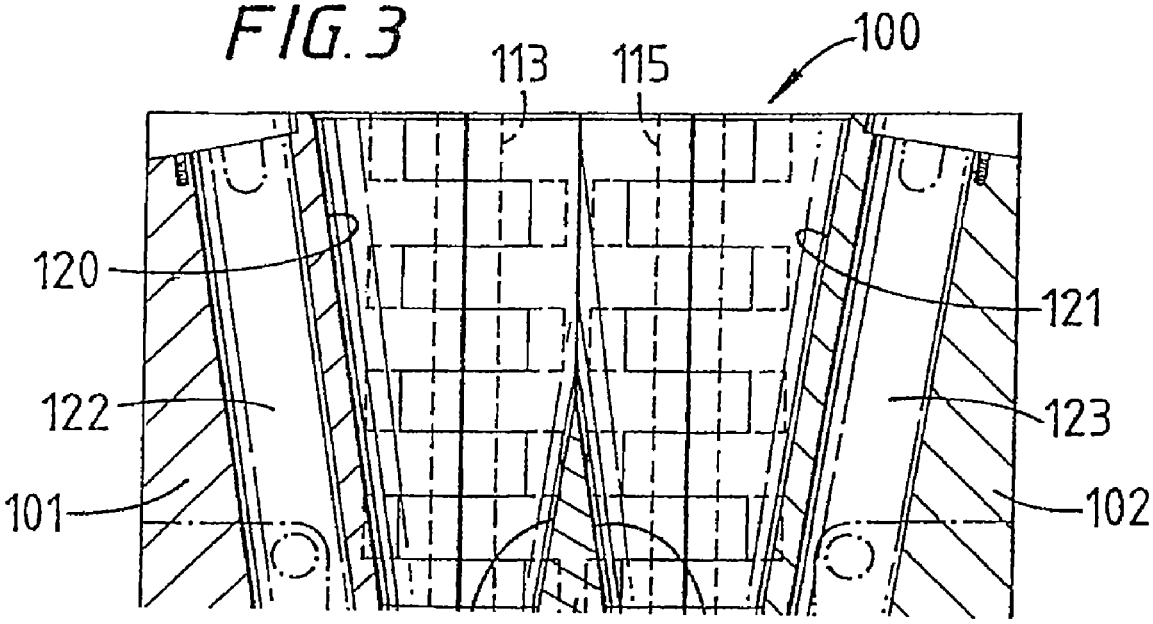
FIG. 3 is a cross sectional view of the apparatus of FIG. 2 taken along the line III-III.
Figure 4:
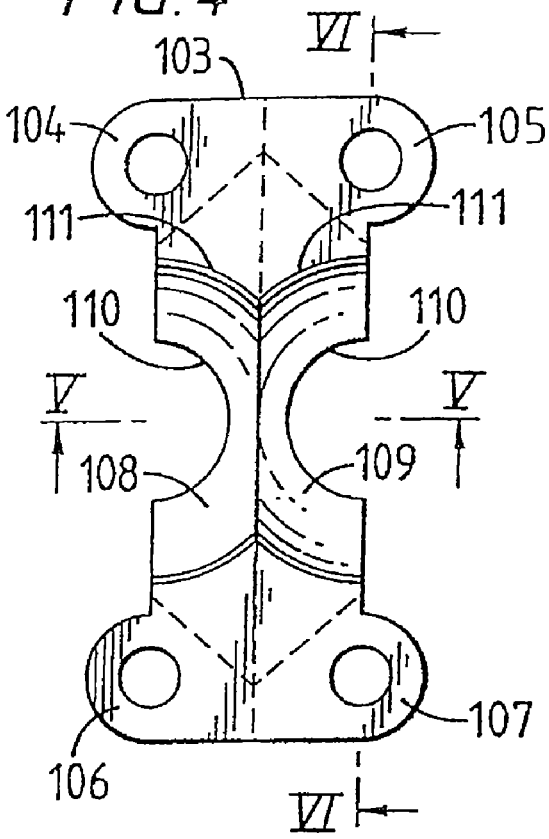
FIG. 4 is a top plan view of part of the apparatus of FIG. 2.
Figure 5:
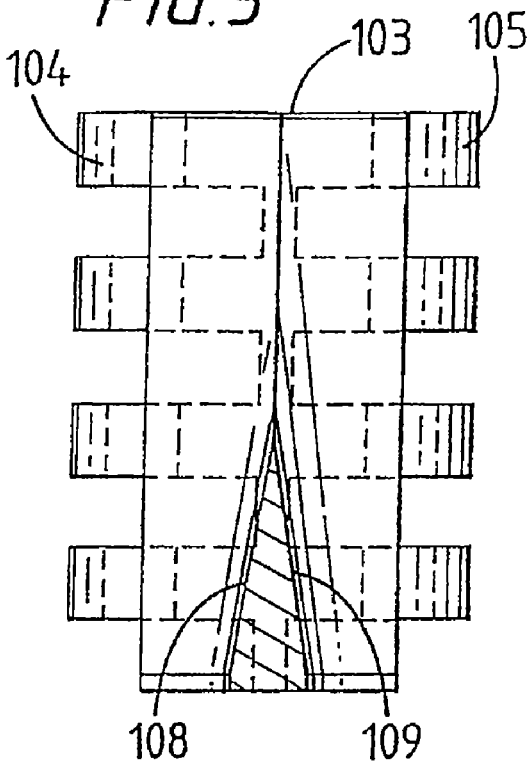
FIG. 5 is a cross sectional view of the part of the apparatus of FIG. 4 taken along the line V-V.

The device 300 is generally similar to the apparatus 100 of FIG. 2 with the additional feature of a recess 301 and 302 in each of the tapered surface 303 and 304 of the converting member 305. The recesses 301 and 302 are sized to accommodate a loom of cables running substantially parallel to the two strings of tubulars. This enables the cable strings to pass through the device for retaining a string of tubulars, for example, through a spider.

It is envisaged that the apparatuses could be used for coiled tubing, as well as tool strings, strings of drill pipe, casing and liners.

While the foregoing is directed to embodiments of the present invention, other and further embodiments of the invention may be devised without departing from the basic scope thereof, and the scope thereof is determined by the claims that follow.

What is claimed is:

1. An apparatus for retaining a tubular, comprising:

a first passage and a second passage, wherein the first passage is larger than the second passage and the first passage having gripping members movable in the first passage adapted to retain the tubular and wherein the second passage is a recess formed in an inner wall of the first passage and is adapted to maintain a string outside a path traveled by the gripping members toward and away from the tubular.

2. The apparatus of claim 1, wherein the first passage is in communication with the second passage.

3. The apparatus of claim 1, wherein the string comprises a cable.

4. The apparatus of claim 3, wherein the apparatus comprises a spider.

5. The apparatus of claim 1, wherein the first passage comprises a tapered surface.

6. The apparatus of claim 1, further comprising a first body part and a second body part, wherein the first body part and the second body part are adapted to retain a tubular.

7. The apparatus of claim 6, wherein the first body part and the second body part are operatively coupled together.

8. The apparatus of claim 6, wherein the first body part and the second body part are hinged on at least one side.

9. The apparatus of claim 6, wherein the first body part and the second body part may be opened on two sides.

10. The apparatus of claim 6, wherein the apparatus comprises a spider.

11. A method of retaining a tubular and at least one connection member, comprising:

providing a tubular handling apparatus having gripping members, a first passage, and a second passage, wherein the second passage is a recess formed in an inner wall of the first passage;

moving the gripping members in the first passage to retain at least a portion of the tubular in the first passage;

maintaining the at least one connection member in the second passage while moving the gripping members to retain at least a portion of the tubular; and running the at least one connection member substantially parallel to the tubular in the first passage.

12. The method of claim 11, wherein the at least one connection member comprises a cable.

13. The method of claim 12, wherein the tubular handling apparatus comprises a spider.

14. The method of claim 11, wherein the first passage comprises a tapered surface.

15. An apparatus for retaining a tubular, comprising:

a first body part and a second body part, wherein the first body part and the second body part are operatively coupled together to retain and support a weight of the tubular, and wherein the first body part and the second body part are openable on two sides to receive the tubular; and a tubular passage and a groove, wherein the tubular passage is formed by coupling the first body part and the second body part and wherein the groove maintains a cable and is formed in a wall of the tubular passage.

16. A method for retaining a tubular and a cable, comprising:

providing a spider having a tubular passage, gripping members, and a recess; installing the spider on a rig floor;

retaining a portion of the tubular in the tubular passage using the gripping members;

passing the cable through the recess and outside of a path traveled by the gripping members; and connecting a tubular section to the tubular, thereby forming an extended tubular.

17. The method of claim 16, further comprising releasing the extended tubular from the spider.

18. The method of claim 17, further comprising:

lowering the extended tubular; and retaining the extended tubular in the tubular passage.

19. The method of claim 16, wherein gripping members travel on a tapered surface of the tubular passage.

20. The method of claim 16, further comprising running the cable substantially parallel to the tubular.

21. The method of claim 16, wherein the tubular passage is accessible by the cable from the recess.

22. A method for retaining a tubular and a cable, comprising:

providing a spider having a bore and gripping members;

retaining a portion of the tubular in the bore using the gripping members; and maintaining the cable in a recess in communication with the bore and outside a path traveled by the gripping members.

23. An apparatus for retaining a tubular, comprising:

a first body part operatively coupled to a second body part to retain and support a weight of the tubular, wherein the first body part and the second body part are openable on two sides to receive the tubular; and a tubular passage and a groove, wherein the tubular passage is formed by coupling the first body part and the second body part and wherein the groove maintains a string and allows the string to pass through the apparatus, wherein the tubular passage is accessible by the string from groove.

24. The apparatus of claim 23, wherein the first body part is coupled to the second body part using a hinge member.

25. The method of claim 23, wherein the string comprises a cable.

* * * * *